US010737315B2

(12) United States Patent
Hirata

(10) Patent No.: US 10,737,315 B2
(45) Date of Patent: Aug. 11, 2020

(54) PRESS DIE

(71) Applicant: TOYOTA BOSHOKU KABUSHIKI KAISHA, Aichi-ken (JP)

(72) Inventor: Kazuyuki Hirata, Toyota (JP)

(73) Assignee: TOYOTA BOSHOKU KABUSHIKI KAISHA, Aichi-ken (JP)

( * ) Notice: Subject to any disclaimer, the term of this patent is extended or adjusted under 35 U.S.C. 154(b) by 208 days.

(21) Appl. No.: 15/817,866

(22) Filed: Nov. 20, 2017

(65) Prior Publication Data

US 2018/0169740 A1 Jun. 21, 2018

(30) Foreign Application Priority Data

Dec. 16, 2016 (JP) ..... 2016-244463

(51) Int. Cl.

| | |
|---|---|
| ***B21D 37/00*** | (2006.01) |
| ***B21J 13/03*** | (2006.01) |
| ***B21J 13/02*** | (2006.01) |
| ***B21D 37/02*** | (2006.01) |

(52) U.S. Cl.

CPC ..... *B21J 13/03* (2013.01); *B21D 37/02* (2013.01); *B21J 13/02* (2013.01)

(58) Field of Classification Search

CPC ..... B21J 13/03; B21J 13/02; B21D 37/02; B21D 37/04; B21D 37/10; B21D 37/12; B21D 37/14; B21D 13/00; B21D 13/02; B21D 22/00; B21D 22/02; B21D 22/10; B21D 37/00

USPC ..... 72/360

See application file for complete search history.

(56) References Cited

U.S. PATENT DOCUMENTS

| | | | | |
|---|---|---|---|---|
| 4,295,352 | A * | 10/1981 | Stokes | B21D 22/10 72/466.8 |
| 4,426,873 | A * | 1/1984 | Pearson | B30B 15/007 72/389.5 |
| 2015/0158075 | A1* | 6/2015 | Hirata | B21J 5/025 72/360 |
| 2016/0068422 | A1* | 3/2016 | Hata | C03B 11/086 65/102 |
| 2017/0368612 | A1* | 12/2017 | Imai | B23B 27/10 |

FOREIGN PATENT DOCUMENTS

| | | |
|---|---|---|
| JP | 2015-131344 | 7/2015 |

* cited by examiner

*Primary Examiner* — Debra M Sullivan

(74) *Attorney, Agent, or Firm* — Greenblum & Bernstein, P.L.C.

(57) ABSTRACT

A press die includes: a die base; a plurality of die members arranged on the die base so as to produce a forming surface; a plurality of shims each of which is interposed between the die base and each of the plurality of die members; and a frame that surrounds the die base, the plurality of die members, and the plurality of shims. Each of the plurality of shims has a hardness higher than the plurality of die members. A regulating means that carries out a regulation so that an amount of displacement of each of the plurality of die members caused by pressure applied during press forming becomes smaller in proportion to proximity of the die member to the frame is provided between the die base and the plurality of die members or provided on the die base.

9 Claims, 6 Drawing Sheets

PRESS DIE

BACKGROUND OF THE INVENTION

The present disclosure relates to a press die that is used to form, for example, a fuel cell separator.

A generally known separator that is used for a fuel cell includes a plate made of a hard metal material, such as titanium, in which concavo-convex portions through which hydrogen, oxygen, etc., are allowed to flow are formed.

Japanese Laid-Open Patent Publication No. 2015-131344 discloses a press die apparatus that has a press die to form the thus structured separator. This press die apparatus includes a lower die that has a concavo-convex upper surface serving as a forming surface and an upper die that has a concavo-convex lower surface corresponding to the forming surface of the lower die. The upper die is disposed so that it can move closer to and away from the lower die. The upper die is moved toward the lower die in a state in which a workpiece plate is placed on the forming surface of the lower die, and, as a result, the workpiece plate is pressed between the forming surfaces of both dies to form concavo-convex portions.

The conventional upper and lower dies disclosed by Japanese Laid-Open Patent Publication No. 2015-131344 each have a base and a plurality of quadrangular-prism-shaped die members that are disposed on the base and that are fitted in a frame in a mutually aligned state. The forming surface is defined by forward end surfaces of the die members.

SUMMARY OF THE INVENTION

This type of press die may be deformed by pressure applied during press forming so that its central part is dented more largely than its outer peripheral part. In other words, the amount of backward displacement of the central part of the forming surface of the die is large, and that of the outer peripheral part thereof is small. Therefore, there has been a case in which highly accurate processing becomes difficult because of the fact that the forming pressure of the central part becomes insufficient, the fact that the start timing or end timing of forming becomes asynchronous between the central part and the outer peripheral part, or the fact that a level difference in forming occurs in an area between the central part and the outer peripheral part of a shaped product.

An object of the present invention is to provide a press die in which the central part of the forming surface of the die is not easily displaced and that is capable of achieving highly accurate processing.

A press die according to one aspect of the present invention includes: a die base; a plurality of die members arranged on the die base so as to produce a forming surface; a plurality of shims each of which is interposed between the die base and each of the plurality of die members; and a frame that surrounds the die base, the plurality of die members, and the plurality of shims. Each of the plurality of shims has a hardness higher than the plurality of die members. A regulating means that carries out a regulation so that an amount of displacement of each of the plurality of die members caused by pressure applied during press forming becomes smaller in proportion to proximity of the die member to the frame is provided between the die base and the plurality of die members or provided on the die base.

Other aspects and advantages of the present invention will become apparent from the following description, taken in conjunction with the accompanying drawings, illustrating by way of example the principles of the present invention.

DETAILED DESCRIPTION OF THE PREFERRED EMBODIMENTS

Embodiments will be hereinafter described with reference to the drawings.

Figure 1:
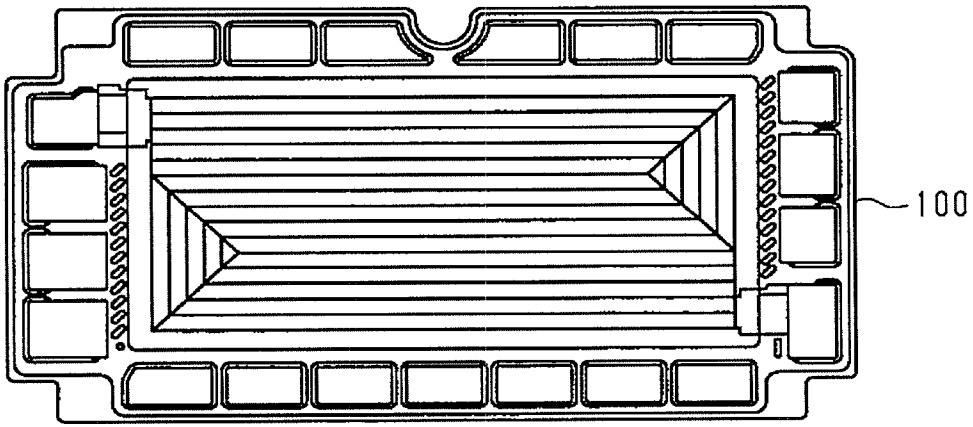
FIG. 1 is a plan view of a fuel cell separator.

A press die apparatus 11 is to process and form a separator 100 for fuel cells shown in FIG. 1.

Figure 2:
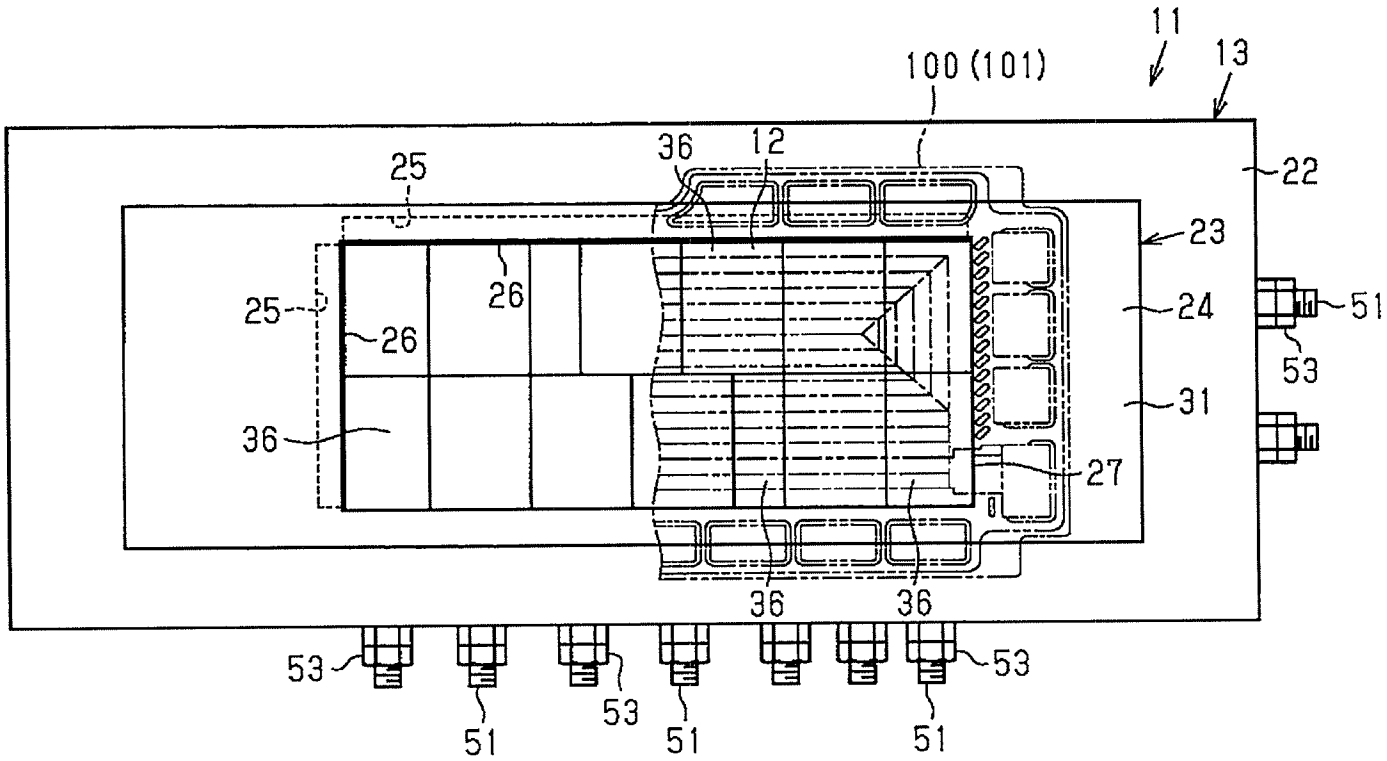
FIG. 2 is a plan view of a press die according to an embodiment.
Figure 3:
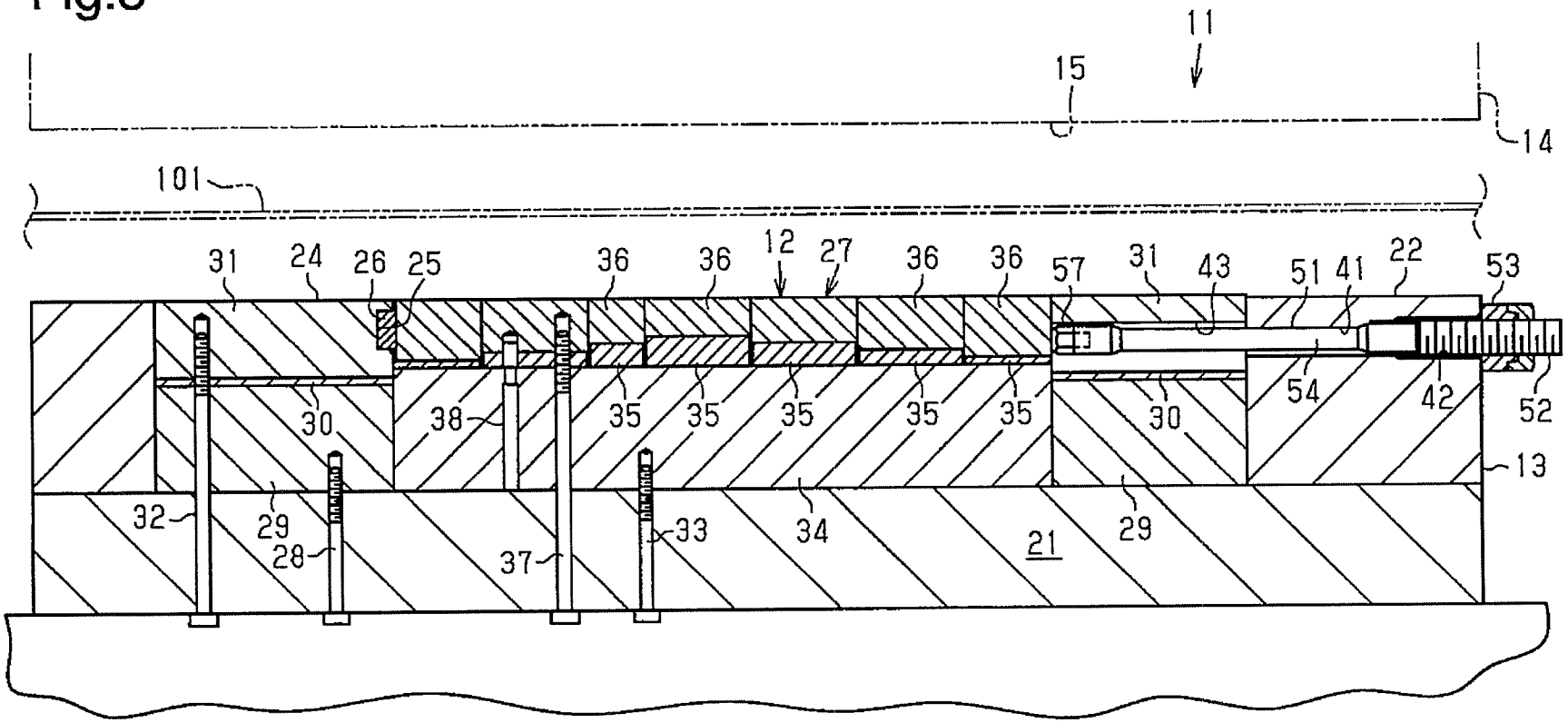
FIG. 3 is a cross-sectional view of the press die of FIG. 2.

As shown in FIG. 2 and FIG. 3, the press die apparatus 11 includes a press die composed of a lower die 13 and an upper die 14 that faces the lower die 13 and that is disposed so that it can move closer to and away from the lower die 13. An upper end surface of the lower die 13 has a forming surface 12 on which a concavo-convex portion (not shown) is made. A lower end surface of the upper die 14 has a forming surface 15 on which a concavo-convex portion is made, which corresponds to the forming surface 12 of the lower die 13. The upper die 14 is moved toward the lower die 13 in a state in which a workpiece plate 101 is placed between the lower die 13 and the upper die 14, and, as a result, the workpiece plate 101 is pressed between the forming surfaces 12 and 15 of both dies 13 and 14 to form the concavo-convex-shaped separator 100.

The upper die 14 is identical in configuration with the lower die 13 except for the fact that the forming surface 15 corresponds to the forming surface 12 of the lower die 13 in a concavo-convex relationship, and therefore the lower die 13 will be described in the present embodiment. The configuration, operation, and effects of the upper die 14 are identical with those of the lower die 13, and therefore a description of the upper die 14 is omitted.

As shown in FIG. 2 and FIG. 3, the lower die 13 has a base 21 and a rectangular outer frame 22 fixed onto the base 21 by means of bolts. The base 21 and the outer frame 22 are made of steel. A die unit 23 is contained inside the outer frame 22. The die unit 23 includes a quadrangular frame-shaped outer die 24, a reference plate 26 fitted into a concave portion 25 formed at two adjoining sides of inner peripheral surfaces of the outer die 24, and an inner die 27 arranged inside the outer die 24.

The outer die 24 includes a die base 29 and a die member 31 placed on the die base 29 with a shim 30 therebetween. The die base 29 is placed on the base 21, and is fixed by a bolt 28. The die member 31 is fixed to the base 21 by means of a bolt 32.

The inner die 27 includes a die base 34 and a plurality of block-shaped die members 36 respectively arranged on the die base 34 with shims 35 therebetween. The die base 34 is placed on the base 21, and is fixed by a bolt 33. Each die member 36 is fixed to the base 21 by means of a bolt 37. Each die member 36 and the shim 35 are temporarily positioned by a positioning pin 38 during assembly.

The forming surface 12 is defined by upper surfaces of the die members 31 and 36.

Figure 4:
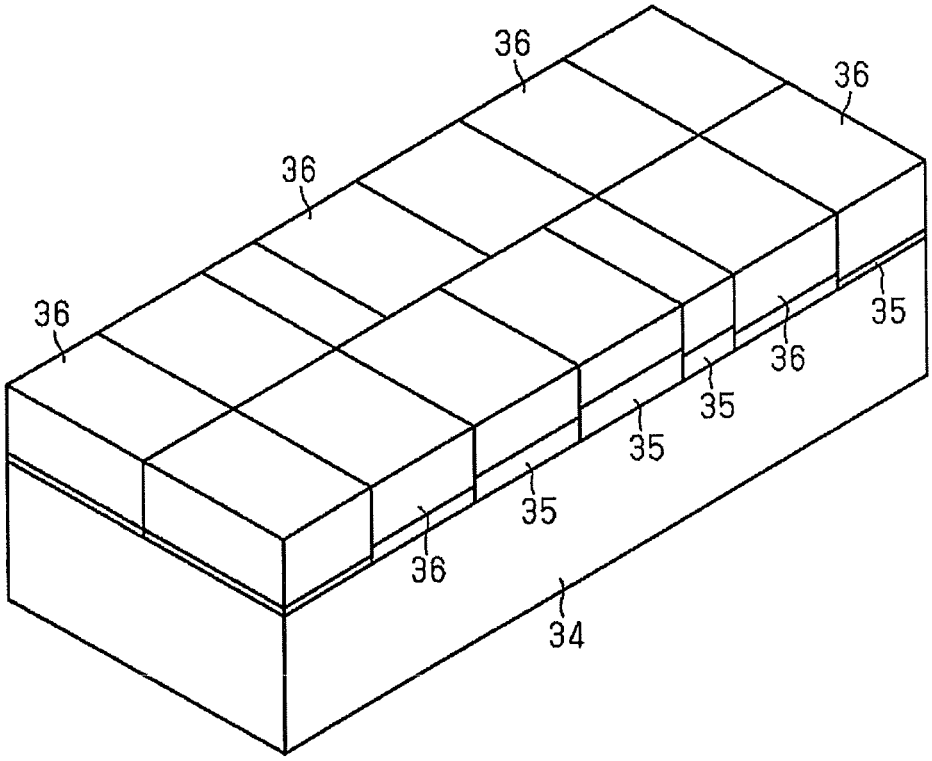
FIG. 4 is a schematic view showing differences in thickness among shims.

The die bases 29 and 34 are made of steel, and the shims 30 and 35 are made of cemented carbide (sintered hard alloy), and the die members 31 and 36 are made of high-speed steel. The shims 30 and 35 are harder than the die members 31 and 36, and hence are not easily deformed. As shown in FIG. 3 and FIG. 4, the thickness of the shim 35 of the inner die 27 becomes larger in proportion to closeness of its position to a central part of the inner die 27. On the contrary, the thickness of the die member 36 becomes smaller in proportion to closeness of its position to the central part so that the upper surface of each die member 36 has the same height. The shim 30 of the outer die 24 is identical in thickness with the thinnest shim 35 of the inner die 27. In the present embodiment, a regulating means is made up of the shims 30 and 35 that differ in thickness from each other as described above.

Figure 5:
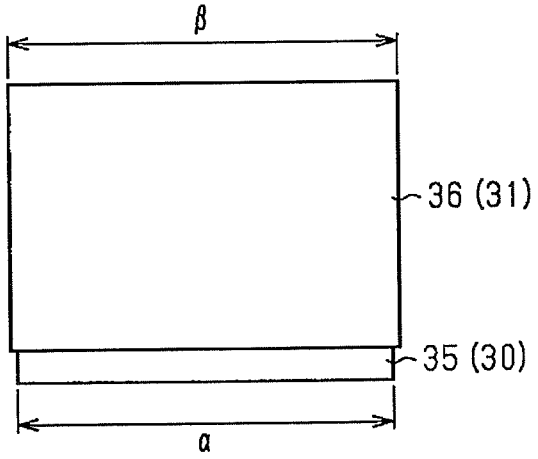
FIG. 5 is a schematic view showing a difference in plane size between a shim and a die member.

The shims 30 and 35 and the corresponding die members 31 and 36 are shaped similarly in a plan view, and, as shown in FIG. 5, an external dimension $\alpha$ of each shim 30, 35 in a plan view is smaller than an external dimension $\beta$ of each die member 31, 36. Additionally, the external shape of the shim 30 of the outer die 24 and the external shape of the die base 29 are formed similarly in a plan view, and the external dimension $\alpha$ of the shim 30 is smaller than an external dimension of the die base 29. A dimensional difference between the external dimension $\alpha$ of the shim 35 of the inner die 27 and the external dimension $\beta$ of the die member 36 is equal to or less than a clearance between a male thread of the bolt 37 that fixes the die member 36 and a female thread of the die member 36 to which the male thread is screwed.

As shown in FIG. 2 and FIG. 3, through-holes 41 pass through the outer frame 22 in two sides on the sides opposite to two sides of the outer die 24 on which the reference plate 26 is placed. As shown in FIG. 3, a through-concave 43 intercommunicating with the through-hole 41 is made in the outer die 24.

A pressing bolt 51 is inserted into the through-hole 41 and the through-concave 43, and its threaded portion 52 is screwed onto a female thread 42 of the through-hole 41. A lock nut 53 is screwed onto the threaded portion 52, and is tightened to an outer peripheral surface of the outer frame 22, so that the rotation of the pressing bolt 51 is blocked.

As shown in FIG. 3, a small-diameter part 54 is formed on the front-end side of each pressing bolt 51. A forward member 57 is fixed to a front end of the pressing bolt 51. The forward member 57 presses the die member 36 of the inner die 27 positioned on the side opposite to the reference plate 26 toward the reference plate 26 by tightening each pressing bolt 51.

Next, the operation of the present embodiment will be described.

Press forming is performed with respect to the workpiece plate 101 between the lower die 13 and the upper die 14, and the separator 100 is formed. In other words, the upper die 14 descends, and then the workpiece plate 101 is pressed between both dies 13 and 14 to form the separator 100.

When press forming pressure acts, the base 21 of the lower die 13, the die base 29 of the outer die 24, and the die base 34 of the inner die 27 become more deformable so as to be moved backwardly in proportion to proximity to their central parts, and become less deformable in proportion to proximity to their outer peripheral parts. Therefore, the forming surface 12 of the lower die 13 becomes more displaceable backwardly in proportion to proximity to its central part. However, the shims 30 and 35 made of cemented carbide having higher hardness than the die members 31 and 36 made of high-speed steel are used in the present embodiment. Furthermore, the shims 30 and 35 become larger in thickness in proportion to proximity to a central part of the lower die 13. As a result, the central part of the forming surface 12 is restrained from being displaced.

According to the present embodiment, it is possible to obtain the following effects.

(1) When press forming pressure acts on the lower die 13, the central part of the forming surface 12 of the lower die 13 is restrained from being deformed backwardly because of a difference in thickness between the shims 30 and 35. Therefore, it is possible to keep the forming surface 12 in a flat state even when the area of the forming surface 12 is large. This advantage is obtained in the upper die 14 as well. Therefore, a deviation between a central part and an outer peripheral part of a press position with respect to the workpiece plate 101 is small over the whole area of the forming surface 12 from the beginning to the bottom dead center of a press step. In other words, press forming pressure evenly acts on the entirety of the workpiece. Therefore, a level difference is less likely to occur in the forming surface 12, and a difference in the amount of press or a difference in the timing of the start or end of press forming is less likely to occur between the central part and the outer peripheral part of the forming surface 12, and therefore it becomes possible to apply highly-accurate processing to the workpiece plate 101.

(2) The advantageous effects stated above can be obtained only by adjusting the thicknesses of the shims 30 and 35. This means that the number of components of the press die does not increase, and the structure is simple.

(3) The external shapes of the shims 30 and 35 in a plan view are similar to the external shapes of the corresponding die members 31 and 36 in a plan view, and are smaller than the external shapes of the corresponding die members 31 and 36 in a plan view. Therefore, corner portions of the die members 31 and 36 closer to the shims 30 and 35 do not hit against the shims 30 and 35. This makes it possible to prevent stress caused by the corner portions of the die members 31 and 36 from concentrating at the shims 30 and 35. Therefore, it is possible to prevent cracks caused by the concentration of stress from occurring in the shims 30 and 35.

The present embodiment may be modified as follows.

Figure 6:
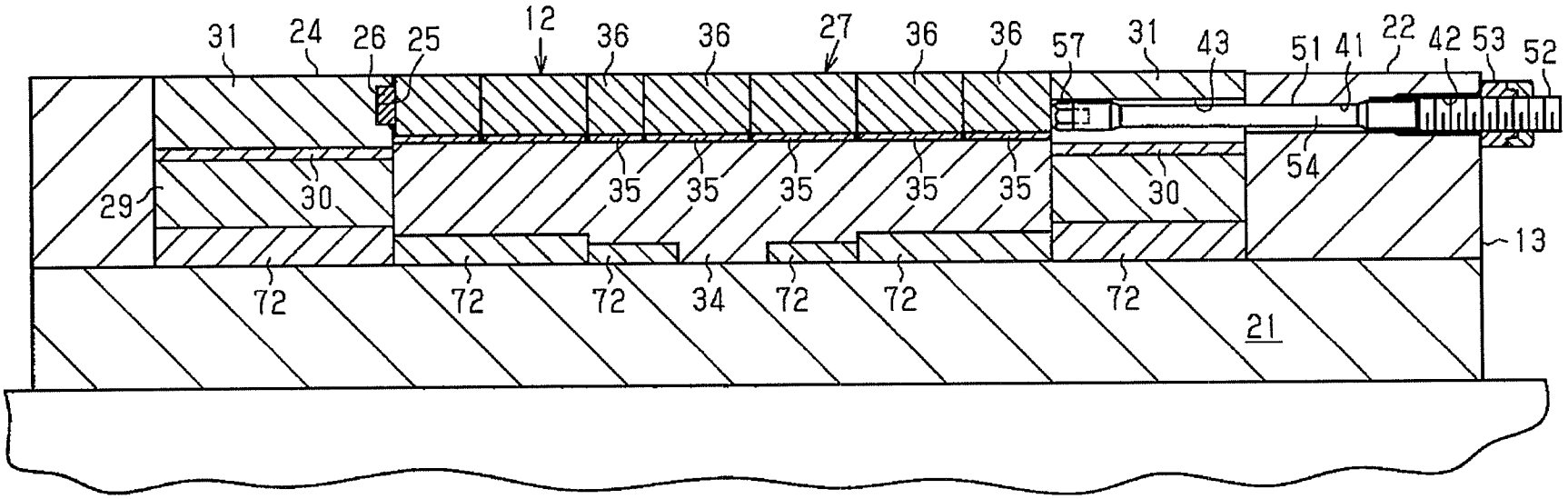
FIG. 6 is a cross-sectional view of a modification of the press die.

As shown in FIG. 6, lower-side shims 72 having thicknesses that become larger in proportion to their proximity to the outer peripheral side may be provided on the lower surfaces of the die bases 29 and 34. In this case, the lower-side shims 72 are made of a material having low hardness that is more easily deformed than the die bases 29 and 34, and the lower-side shims 72 serve as the regulating means. In the modification of FIG. 6, the lower-side shims 72 form a portion of the die bases 29 and 34. Therefore, the die bases 29 and 34 become more deformable in proportion to proximity to their outer peripheral sides. This makes it possible to restrain the central part of the forming surface 12 from being displaced backwardly more than the outer peripheral part. In this case, the shims 30 and 35 made of cemented carbide between the die bases 29, 34 and the die members 31, 36 are allowed to have an even thickness. It is also possible to make the lower-side shims 72 of a hard material less deformable than the die bases 29 and 34. In this case, contrary to the modification of FIG. 6, the thicknesses of the lower-side shims 72 are made smaller in proportion to the proximity of the lower-side shims 72 to the outer peripheral side.

Figure 7:
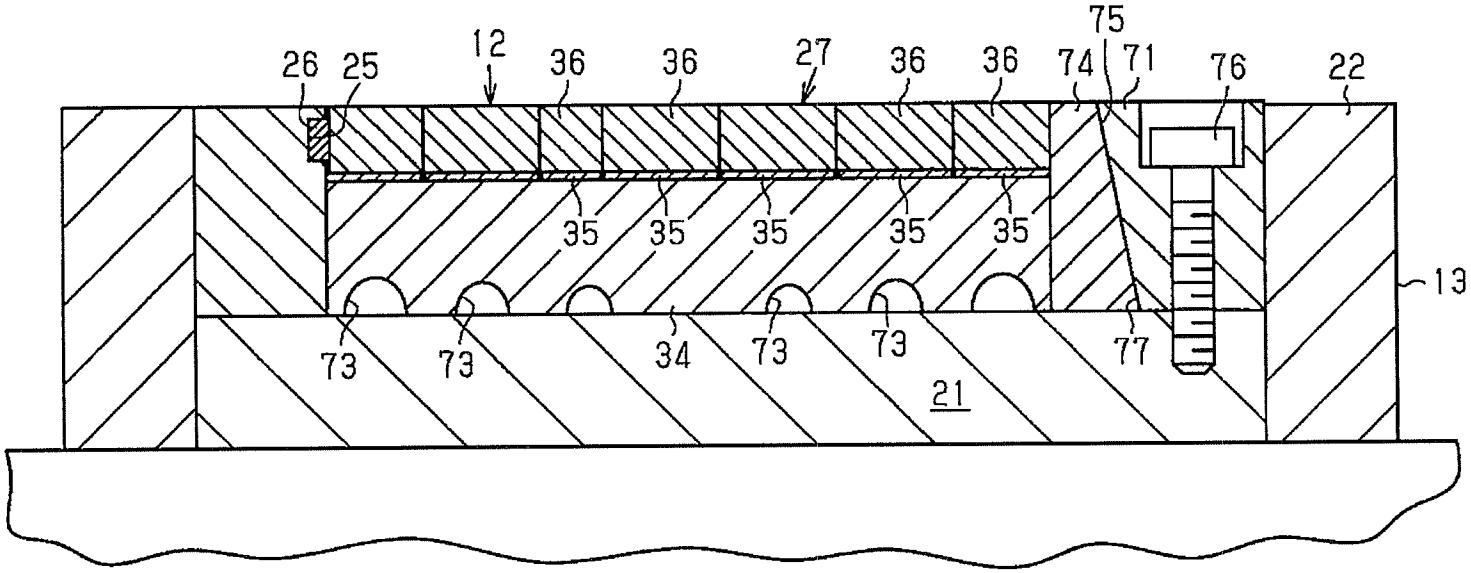
FIG. 7 is a cross-sectional view of another modification of the press die.

As shown in FIG. 7, the die base 34 may be provided with a plurality of concave portions 73, the volume of which become larger in proportion to proximity to the outer peripheral side of the die base 34. The concave portions 73 serve as the regulating means. As a result, the die base 34 becomes more deformable in proportion to proximity to its outer peripheral side. This makes it possible to make the shims 35 made of cemented carbide between the die base 34 and the die member 36 uniform in thickness with each other in the same way as in the modification of FIG. 6. In the modification of FIG. 7, the pressing bolt 51 is not provided. Additionally, a frame member 71 that does not have the forming surface 12 and that is fixed to the base 21 by means of a bolt 76 is provided instead of the outer die 24 having the forming surface 12. Therefore, the forming surface 12 is defined only by the die members 36. Additionally, a wedge member 74 having an inclined surface 75 between the frame member 71 and the inner die 27 is provided instead of the pressing bolt 51, and the frame member 71 is provided with an inclined surface 77 that is in contact with the inclined surface 75 of the wedge member 74. Therefore, in the modification of FIG. 7, the inner die 27 is pressed against the reference plate 26 and is fixed by a wedge effect produced by tightening the bolt 76. In order to adjust the degree of deformation of the die base 34, it is also possible to adjust the concave portions 73 in number, in size, or in position.

The shims 30 and 35 may be made identical with the die members 31 and 36 in shape and in size in a plan view.

Without providing the lower-side shims 72, the die members 36 may become smaller in thickness in proportion to their proximity to the outer peripheral side so that the die member 36 disposed closer to the outer peripheral side is more easily displaced.

The shims 30 and 35 may be a layered piece consisting of thin shims, and the thicknesses of the shims 30 and 35 may be adjusted in proportion to the number of stacked shims.

The die bases 29 and 34 may be made integrally with the base 21.

The die base 34 of the inner die 27 may be divided correspondingly to the die members 36. In this case, preferably, the die base 34 has a greater shape in a plan view than the shim 35 so that a corner portion of each die base 34 does not hit against the shim 35.

The die bases 29 and 34 may be made of cemented carbide. In this case, the hardness of each of the die bases 29 and 34 increases, and therefore it is possible to make the die bases 29 and 34 smaller in thickness, and hence make the outer frame 22 smaller in thickness. This makes it possible to thin the press die apparatus 11, i.e., makes it possible to make the press die apparatus 11 compact.

The above embodiments are intended to be illustrative, and the present invention is not limited to the above-described embodiments. Various alternatives, modifications and variations are possible to the disclosed exemplary embodiments without departing from the spirit and scope of the present invention. For example, the subject matter of the present invention may exist in fewer features than all of the features of the particular embodiments disclosed. The claims are incorporated into the detailed description and each claim by itself claims a separate embodiment. The scope of the invention is intended to embrace all such alternatives, modifications and variations, along with all equivalents thereof, within the scope of the claims.

The invention claimed is:

1. A press die comprising:

a die base;

a plurality of die members arranged on the die base so as to produce a forming surface;

a plurality of first shims, wherein each first shim is interposed between the die base and each die member; and a frame that surrounds the die base, the plurality of die members, and the plurality of first shims;

wherein each first shim has a hardness higher than the plurality of die members, and wherein the press die comprises one of: (i) the plurality of first shims having thicknesses that become smaller in proportion to proximity to the frame, and the plurality of die members having respective thicknesses that become larger in proportion to proximity to the frame; (ii) a plurality of second shims incorporated into a bottom portion of the die base and having a lower hardness than the die base, the plurality of second shims having respective thicknesses that become larger in proportion to proximity to the frame; (iii) a plurality of second shims incorporated into the bottom portion of the die base and having a higher hardness than the die base, the plurality of second shims having respective thicknesses that become smaller in proportion to proximity to the frame; or (iv) a plurality of concave portions provided in the die base, the plurality of concave portions having respective volumes that become larger in proportion to proximity to the frame, so that an amount of displacement of each die member caused by pressure applied during press forming is substantially the same across the forming surface.

2. The press die according to claim 1, wherein a shape of each first shim is similar to a shape of a corresponding one of the die members in a plan view and has a size equal to or less than the shape of the corresponding one of the die members in a plan view.

3. The press die according to claim 1, wherein the plurality of die members are made of high-speed steel, and the plurality of first shims are made of cemented carbide.

4. The press die according to claim 1, comprising (i) the plurality of first shims having thicknesses that become smaller in proportion to proximity to the frame, and the plurality of die members having respective thicknesses that become larger in proportion to proximity to the frame.

5. The press die according to claim 1, comprising (ii) the plurality of second shims incorporated into the bottom portion of the die base and having a lower hardness than the die base, the plurality of second shims having respective thicknesses that become larger in proportion to proximity to the frame.

6. The press die according to claim 5, wherein the die base is made of cemented carbide.

7. The press die according to claim 1, comprising (iii) the plurality of second shims incorporated into the bottom portion of the die base and having a higher hardness than the die base, the plurality of second shims having respective thicknesses that become smaller in proportion to proximity to the frame.

8. The press die according to claim 1, comprising (iv) the plurality of concave portions provided in the die base, the plurality of concave portions having respective volumes that become larger in proportion to proximity to the frame.

9. The press die according to claim 8, wherein the die base is made of cemented carbide.

* * * * *